United States Patent [19]

Neunzig

[11] Patent Number: 4,861,343

[45] Date of Patent: Aug. 29, 1989

[54] PROCESS TO ENCLOSE FLOCK TOW IN A PERMEABLE SLEEVE FOR DYEING OR TEXTILE TREATMENT BEFORE CUTTING INTO A FLOCK

[75] Inventor: Franz-Theo Neunzig, Rommerskirchen, Fed. Rep. of Germany

[73] Assignee: Bayer Aktiengesellschaft, Leverkusen, Fed. Rep. of Germany

[21] Appl. No.: 53,793

[22] Filed: May 26, 1987

[30] Foreign Application Priority Data

Jun. 6, 1986 [DE] Fed. Rep. of Germany ..... 3619033

[51] Int. Cl.[4] ..... B05D 1/14; D01G 1/06; D06B 5/14; D06M 11/04

[52] U.S. Cl. ..... 8/488; 8/918; 8/922; 8/924; 8/927; 8/928

[58] Field of Search ..... 8/488

[56] References Cited

U.S. PATENT DOCUMENTS 4,014,648 3/1977 Walsh et al. ..... 8/138

FOREIGN PATENT DOCUMENTS 2431847 8/1975 Fed. Rep. of Germany .
2800109 9/1979 Fed. Rep. of Germany .

OTHER PUBLICATIONS

"The American Heritage Dictionary", Second College Edition, Houghton Mifflin Company, Boston, p. 1150.
"Concise Chemical and Technical Dictionary", Third Enlarged Edition, Chemical Publishing Col, Inc., N.Y., N.Y. (1974), p. 947.

*Primary Examiner*—A. Lionel Clingman
*Attorney, Agent, or Firm*—Connolly and Hutz

[57] ABSTRACT

Flock is prepared by introducing a flockmaking tow into a sleeve, subjecting it in this form to at least one treatment bath, then removing it from the sleeve and subsequently cutting it into flock.

11 Claims, 3 Drawing Sheets

PROCESS TO ENCLOSE FLOCK TOW IN A PERMEABLE SLEEVE FOR DYEING OR TEXTILE TREATMENT BEFORE CUTTING INTO A FLOCK

The invention relates to a process for preparing flock from synthetic fibres, in particular from polyacrylonitrile fibres and polyamide fibres.

The process of mechanical and electrostatic flocking is known and widely used. In this process, fibres having a length of up to 15 mm, mainly within the range of up to 3 mm, which have a certain surface conductivity required for the electrostatic but also for the mechanical flocking process are applied to a base which has been provided with adhesives, so that a velourslike surface is produced. The preparation of flock fibres is described for example in Swiss patent specification No. 426,723, DE-A-2,431,847 and DE-A-2,800,109. In the known processes, the flockmaking tow, irrespectively of whether ecru, mass-coloured or tow-dyed, is first of all cut into the length of fibre desired for the process, then dyed if desired and subsequently provided in a plurality of steps with the necessary electrostatic surface finish.

This process has a series of disadvantages. For example, washing, dyeing and finishing takes place in a plurality of stages in a very long liquor ratio of 15:1 to 40:1, depending on the denier and staple length of the flock. The process thus uses a very large amount of water, the heating of which to the necessary temperatures has a high energy consumption.

Since the dyeing and the electrostatic treatment of the flock is effected with vigorous stirring and as a result the flock particles are subjected to a high shear stress, the flock fibres undergo distinct geometric changes. The distortion of the flock particles can be so pronounced that only a qualitatively inferior flocking is possible. Moreover, in certain circumstances such a qualitatively inferior flock can only be processed with a low flocking speed, as a result of which economic disadvantages can arise.

The invention had for its object to prepare high-grade flock in a simple and inexpensive manner and to avoid the above-described disadvantages.

Figure 1:
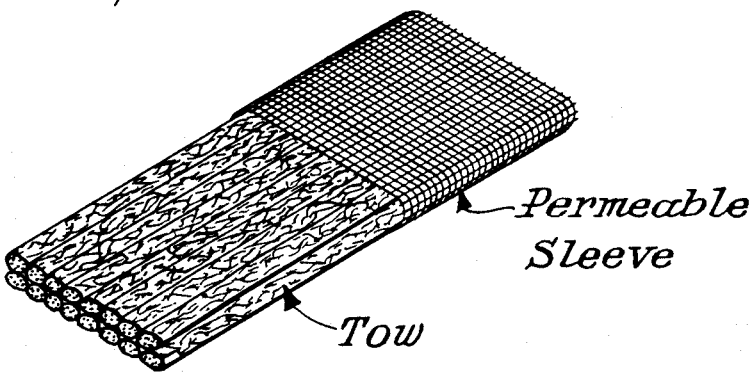
FIG. 1 is a fragmental pictorial view of a tow and permeable sleeve illustrating the embodiment of this invention.
Figure 2:
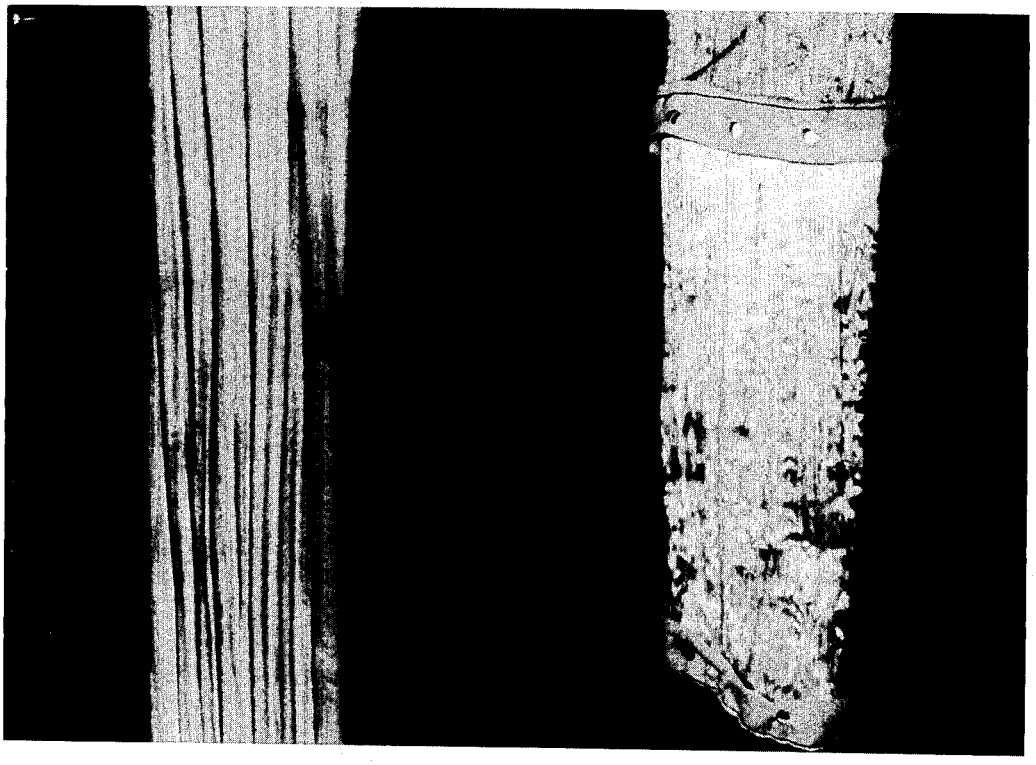
FIG. 2 is a photograph of the tow and permeable sleeve during manufacture.
Figure 3:
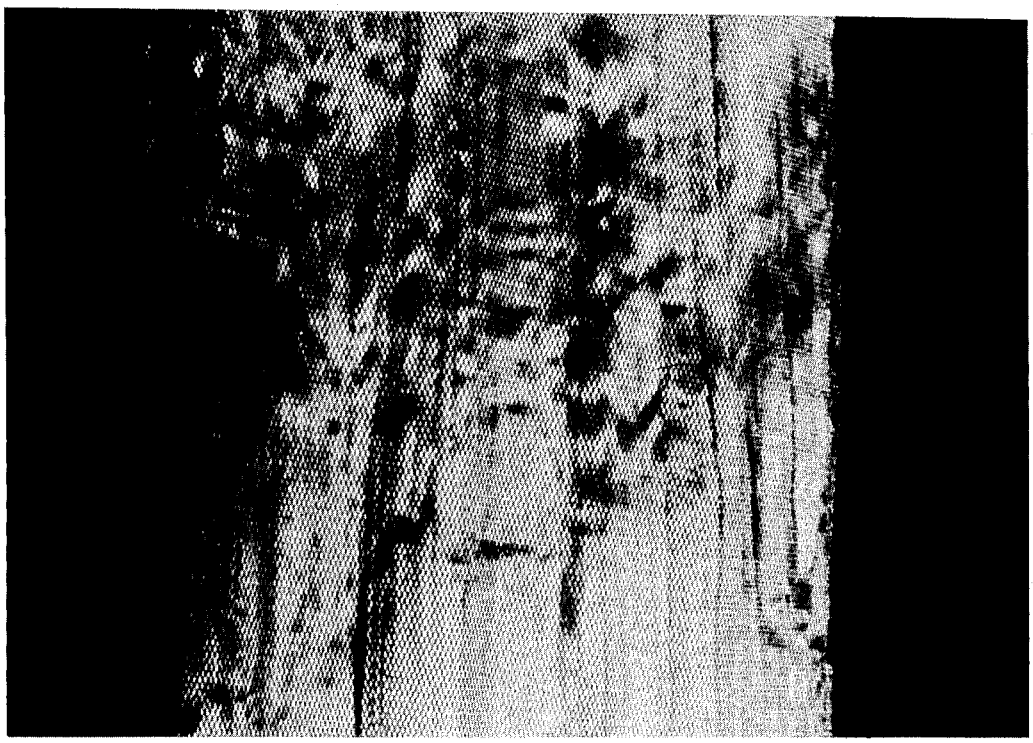
FIG. 3 is an enlarged photograph of the tow and permeable sleeve shown in FIG. 2.
Figure 4:
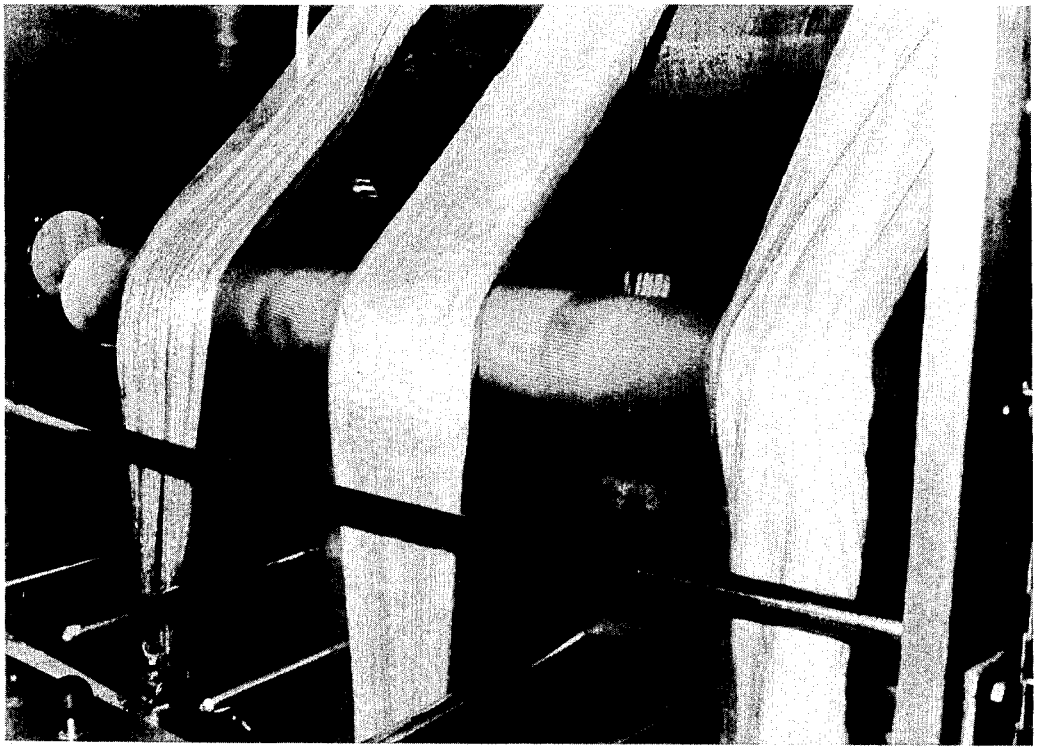
FIG. 4 and FIG. 5 are photographs of the tow and permeable sleeve shown entering liquid treatment bath.
Figure 5:
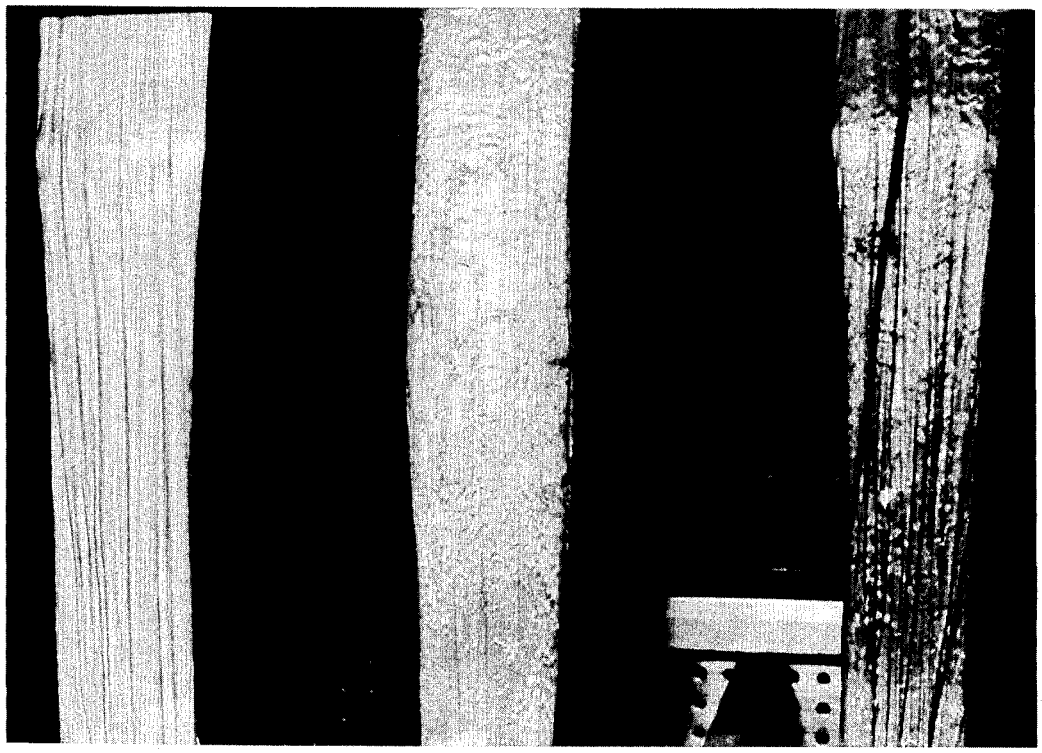

The invention as shown in FIGS. 1–5 relates to a process for preparing a flock for mechanical and/or electrostatic flocking from a flockmaking tow and treating the flock in a treatment liquid, characterized in that the flockmaking tow is introduced into a sleeve which is permeable to the liquid of the treatment bath, is subjected in this form to at least one treatment bath and is then cut into flock.

Preferably the sleeve is taken out before the flock is cut. However, it is also possible not to remove the sleeve from the flockmaking tow but to cut the sleeve concomitantly in the cutting process and to separate it subsequently from the flock, for example by sieving.

The flockmaking tow preferably consists of a bundle of endless parallel fibres. Especially preferably they are manmade fibres, in particular viscose, polyacrylonitrile, polyamide and polyester fibres. Particular preference is given to polyacrylonitrile and polyamide. The flockmaking tow introduced into the tubular sleeve preferably has a tow linear density of 25 ktex to 3000 ktex, in particular of 50 ktex to 1500 ktex. The sleeve preferably consists of a sheetlike structure of a chemical composition other than that of the flockmaking tow. The sleeve should not be chemically modified in the treatment processes and therefore consist of inert material. It can for example consist of a perforated film or of a textile net, including for example a knitted product, a woven fabric, nonwoven or filament mesh. In a preferred embodiment, the sleeve consists of a knitted net or a circular knit made of polyester, polyamide or polypropylene.

The treatment bath is in general a dyebath or a finishing bath containing textile auxiliaries for fibre finishing. It is also possible to use a plurality of these baths in succession. In a preferred embodiment, the flockmaking tow in the tubular sleeve is subjected first to a dyebath and then to at least one bath containing suitable textile auxiliaries. The dyebath can be in any machine known per se and customary in the trade for processing tubular endless textile material, for example a winch beck or a jet dyeing apparatus. The treatment in the dyebath takes place under conditions customary per se, although the water consumption can be reduced by 25 to 50% compared with the processes known from the above-mentioned patent specifications. The possible reduction in water consumption represents an additional energy saving and reduces the waste water pollution of biological water treatment plants. It is possible to use the dyestuffs known and customary for the dyeing of manmade fibres.

Suitable fibre finishes are mineral salts, tannins, tanning agents, potassium antinonyltartrate as well as anion-active or nonionic fibre finishes and combinations of these products.

Suitable anion-active compounds are for example:

$C_{12}$-$H_{25}OSO_3Na$ $C_{18}H_{37}OSO_3Na$ $C_{12}H_{25}O(CH_2CH_2O)_4SO_3Na$ $[C_{18}H_{35}O(CH_2CH_2O)_5]_2PONa$
$\downarrow$
$O$ Sulphonation products of vegetable and animal oils, such as, for example, the sulphonation product of olive oil, castor oil, sperm oil or beef tallow.

Suitable nonionic products have for example the formulae $C_{18}H_{37}CON(CH_2CH_2OH)_2$ $C_{18}H_{37}COO(CH_2CH_2O)_6H$ $C_{18}H_{37}O(CH_2CH_2O)_{20}H$ Preference is given to anion-active compounds, for example to the sulphates of higher molecular weight alcohols.

The application of finish can be effected not only in the same bath, at, for example, the same or a lower temperature and the same pH value, but also successively in separate baths at different temperatures from the first treatment and other pH values.

The process according to the invention can be carried out for example as follows:

The flockmaking tow is introduced in the tubular sleeve in a commercially customary winch beck into an aqueous solution containing a dyestuff at 20° C. to 40° C. To obtain an endless belt of tow, the two ends of the sleeve are connected to each other in a suitable manner, for example by overlapping, sewing together or entangling (splicing) of the tow ends.

This aqueous liquor has a pH value between 4 and 8. The ratio of flockmaking tow: aqueous liquor is between 1:8 and 1:25. Subsequently the flockmaking tow is dyed at suitable temperatures, in the case of polyacrylonitrile fibres between 80° and 100° C., in the case of polyamide fibres between 60° and 100° C.

After dyeing, the liquor temperature is reduced to 50°-70° C., and the chemicals required in the 1st finishing stage are added to the liquor in succession. Preferred chemicals for this purpose are potassium aluminium sulphate (alum), tannins, potassium timonyltartrate (tartar emetic) and acetic acid. After removal of aqueous liquor and introduction of a new liquor, the tow is treated at temperatures between 15° and 50° C., preferably between 20°-45° C., superficially in succession with anion-active or nonionic softeners, potassium aluminium sulphate and alkali metal salts, preferably sodium chloride, ammonium sulphate or sodium acetate.

On completion of the dyeing and finishing process, the moist flockmaking tow is removed from the dyeing apparatus, is preferably freed from the surrounding inert sleeve for the avoidance of fibre entanglement and is cut in a manner known per se on flock cutting machines into flock. The still moist cut material is subsequently dried in a manner known per se, is freed by sieving from irregularities and is conditioned to be ready for use.

The process has a series of advantages which distinguishes it from the hitherto customary processes.

For example, the flock thus produced is virtually free of distortions. This considerably increases the surface density of the flocked articles, for example by up to 50%, and hence significantly upgrades the quality of the articles.

Alternatively, to obtain an otherwise customary flock surface density, the production speed in the flocking process can be considerably increased.

In addition, lack of distortion also makes it possible to produce longer flock than standard material from finer deniers and to process it.

The possibility of being able to effect the dyeing of the flockmaking tow inside the tubular sleeve also in pressurized commercially customary dyeing apparatuses, for example jet dyeing apparatuses, and hence to obtain dyeing temperatures above 100° C. considerably reduces the time required for dyeing. In addition, the fastness of the dyeing can be improved and the exhaustion of the dyeing liquors can be raised, thereby reducing environmental pollution.

The water consumption required for dyeing and finishing the flock can be reduced to 25-50% of the known original process while nevertheless obtaining improved properties of the flock.

The machine outlay for dyeing is smaller, thereby making it possible to reduce investments for the flock production plant.

For instance, it is possible to dispense with a centrifuge, since the dyed and finished flockmaking tow only has a water content of 30-60% after squeeze-off and can be directly dried after cutting.

The examples below serve to describe the process without thereby exhausting the possibilities.

EXAMPLE 1

11 polyacrylonitrile flockmaking bundles having a fibre denier of 0.6 dtex and a bundle denier of 90 ktex are combined to form a tow of 990 ktex and sewn into a knitted polyester net. 10 linear meters of this tow are introduced into a commercially customary dyeing beck having a capacity of 100 liters and are joined together at the ends. The tow is subsequently dyed with a commercially available dyestuff at 98°-99° C. for 1 hour.

After dyeing, the liquor is discharged, and the tow cooled down to 66° C. by adding cold water. This is followed by the two-stage finishing of the tow with textile auxiliaries.

| Stage 1 | | | |
|---|---|---|---|
| 0.25 g/l | Potassium aluminium sulphate | Treatment duration | 10 min |
| 1.3 g/l | Tannin | Treatment duration | 10 min |
| 0.5 g/l | Acetic acid | | |
| 0.7 g/l | Potassium antimonyltartrate | Treatment duration | 10 min |

After the liquor has been discharged, the tow is dewatered by squeezing off to a residual moisture content of about 50% and is subsequently introduced again into the back as described above. After the liquor of fresh water has been heated to 45° C. the second finishing stage is effected:

| Stage 2 | | | |
|---|---|---|---|
| 2 g/l | of an anion-active softener | Treatment duration | 10 min |
| 10 g/l | $(NH_4)_2SO_4$ technical grade | Treatment duration | 10 min |
| 1 g/l | aluminium potassium sulphate $\times$ 12 $H_2O$ | Treatment duration | 10 min |

After the bath has been discharged and the tow has been dewatered to a residual moisture content of about 50%, the sleeve is removed and the tow is fed into an FLN 120 Pekrun cutter and is cut into flock having a length of 0.6 mm.

The still moist cut material is dried in a known manner in a cyclone dryer at 70° C., is freed of irregularities by sieving and is conditioned at 20° C./65% relative humidity. The flock thus produced has a resistance of $8\times10^6$ ohm, measured in accordance with DIN 54345, sheet 1, and has a very good fluency. It is substantially free of distortions and in the electrostatic flocking in an aqueous acrylate dispersion a surface density up to 50% higher than with conventionally produced flock is achieved (see table).

EXAMPLE 2

10 polyacrylonitrile flockmaking bundles having a fibre denier of 3.3 dtex and a bundle denier of 95 ktex are combined to give a tow of 950 ktex and sewn into a polypropylene net, 15 linear meters of this tow are introduced into a commercially customary dyeing beck together with 120 liters of water and are joined together therein at the ends. The tow is subsequently dyed with a commercially available dyestuff and a dyeing time of 1 hour at 98°–99° C.

After dyeing, the liquor is cooled down at 66° C. by adding cold water. This is followed by the two-stage finishing of the tow:

| Stage 1 | | | |
|---|---|---|---|
| 0.25 g/l | Aluminium potassium sulphate × 12 $H_2O$ | Treatment duration | 10 min |
| 1.3 g/l | Tannin | Treatment duration | 10 min |
| 0.5 g/l | Acetic acid | | |
| 0.7 g/l | Potassium antimonyltartrate | Treatment duration | 10 min |

After the liquor has been discharged, the tow is dewatered to a residual moisture content of about 50% by squeezing off and is subsequently introduced again into the beck as described above. After the liquor has been heated up to 45° C., the second finishing stage is carried out:

| Stage 2 | | | |
|---|---|---|---|
| 2 g/l | of an anion-active softener | Treatment duration | 10 min |
| 10 g/l | $(NH_4)_2SO_4$ technical grade | Treatment duration | 10 min |

After the bath has been discharged and the tow has been dewatered to a residual moisture content of about 50%, the sleeve is removed and the tow is cut into flock having a length of 1.5 mm.

The still moist cut material is dried in a known manner in a cyclone dryer at 70° C., is freed of irregularities by sieving and is conditioned at 20° C./65% relative humidity. The flock thus produced has a resistance of $2\times10^7$ ohm, measured in accordance with DIN 54345, sheet 1, and has a very good fluency. It is substantially free of distortions and in the electrostatic flocking in an aqueous acrylate dispersion a surface density up to 50% higher than with conventionally produced flock is achieved (see table).

EXAMPLE 3

10 nylon-6-flockmaking bundles having a fibre denier of 3.3 dtex and a bundle denier of 100 ktex, combined to give a tow of 1000 ktex and a length of 10 m, are sleeved as described in Example 1 with a knitted polyester net and is introduced into the dyeing beck and subsequently dyed with a commercially available dyestuff. After a short prerun at 40° C., the temperature is raised to 98° C. in 30 min. and subsequently maintained for 30 min.-for dyeing.

After dyeing, the liquor is cooled down to 66° C. by adding cold $H_2O$, and the tow is finished in two stages:

| Stage 1 | | | |
|---|---|---|---|
| 0.2 g/l | Aluminium potassium sulphate × 12 $H_2O$ | Treatment duration | 10 min |
| 1.0 g/l | Tannin | Treatment duration | 10 min |
| 0.5 g/l | Acetic acid | | |
| 0.5 g/l | Potassium antimonyltartrate | Treatment duration | 10 min |

After the liqour has been discharged and the tow dewatered to a residual moisture content of 50%, the flockmaking tow is again introduced into the dyeing beck as described in Example 1 and again finished at 40° C.

| Stage 2 | | | |
|---|---|---|---|
| 3 g/l | of an anion-active softener | Treatment duration | 20 min |
| 10 g/l | NaCl | | |
| 0.2 g/l | Ammonium stearate | | |

After the flockmaking tow has been squeezed off to a residual moisture content of about 40%, the sleeve is pulled off the tow and the tow is fed into a flockcutting machine and cut into flock having a length of 1.25 mm. The moist cut material is then treated as described in Example 1.

After conditioning, the flock has a surface resistance of $6\times10^7$ ohm, has a good fluency and good jumping capacity in an electric high-voltage field. The flock is substantially free of distortions. A flocking carried out in an acrylate dispersion exhibits in this case too a high flocking density than in the case of a flock produced by conventional processes (see table).

COMPARATIVE EXAMPLE 4

10 polyacrylonitrile flockmaking bundles having a fibre denier of 3.3 dtex and a bundle denier of 95 ktex are cut on a flock-cutting machine of the type described in Example 2 into flock having a length of 1.5 mm. The flock is subsequently dyed in a stainless steel vessel in a liquor ratio of 30:1 with thorough stirring by means of a metallic propellor stirrer introduced into the water/-flock dispersion in the manner described in Example 2. To avoid the dyeing liquor from foaming over in the vicinity of boiling point, the dyeing temperature is limited to a maximum of 97° C. This prolongs the dyeing time compared with Example 2 to two hours. After the dyestuff has been taken up by the fibres, the temperature of the liquor is reduced to 66° C. by adding cold water, and the flock is finished stagewise with the products described in Example 2 in two stages:

| Stage 1 | | | |
|---|---|---|---|
| 0.25 g/l | Potassium aluminium sulphate | Treatment duration | 10 min |
| 1.3 g/l | Tannin | Treatment duration | 10 min |
| 0.5 g/l | Acetic acid | | |
| 0.7 g/l | Potassium antimonyltartrate | Treatment duration | 10 min |

After the liquor has been discharged, the flock is dewatered in a centrifuge to a residual moisture content of 20%, is then introduced again into the vessel and is treated in stage 2 in the same liquor ratio with the finished products described in Example 2. Thereafter the flock is again dewatered in a centrifuge and dried in a known manner in a cyclone dryer at 70° C., is freed by sieving from irregularities and is conditioned at 20° C. and 65% relative humidity. The flock has a resistance of $9\times10^6$ ohm and has only a moderate fluency. The predominant portion of the flock particles has been drastically altered in its geometric shape, i.e. distorted, repeatedly bent or crimped. Electrostatic flocking into an aqueous acrylate dispersion give a surface density of 83 g/m$^2$.

COMPARATIVE EXAMPLE 5

11 polyacrylonitrile flockmaking bundles having a fibre denier of 0.6 dtex and a bundle denier of 90 ktex are cut on a flock-cutting machine as described in Example 1 into flock having a length of 0.6 mm. The flock is subsequently dyed and electrostatically finished in a liquor ratio of 40:1 as described in Example 4. After conditioning the flock has a resistance of $5\times10^6$ ohm. As a consequence of the pronounced change in the flock geometry detectable under the microscope in respect of virtually all flock particles, the flock only has a poor fluency. On flocking into an aqueous acrylate dispersion a surface density of 35 g/m$^2$ is obtained.

COMPARATIVE EXAMPLE 6

10 nylon 6 flockmaking bundles having a fibre denier of 3.3 dtex and a bundle denier of 100 ktex are combined to form a tow of 1000 ktex and cut with a flockcutting machine as described in Example 1 into flock having a length of 1.25 mm. The flock is then dyed in a liquor ratio of 20:1 at a temperature of 85° C. and finished as described in Example 4. After conditioning, the flock has a resistance of $4\times10^6$, but only has a poor fluency. A large portion of the flock particles is slightly distorted. On flocking into an aqueous acrylate dispersion a surface density of 105 g/m$^2$ is obtained.

Flocking of carrier materials

To assess the surface density of the flock in flocking, comparable flocking tests were carried out with the flock produced by way of example. For this purpose, a hydrophobed plain weave of a 50/50 cotton/polyester yarn was coated with a customarily thickened dispersion of a polyacrylic acid ester copolymer in a layer thickness of 300 μm.

The coated textile thus prepared was positioned on a vibrating metal plate. Between the coated textile and the flock-receiving metering sieve there was, at a distance of 100 mm from the textile, a metal electrode composed of a sieve fabric, for example having a mesh width of 4.7 mm. The electrode was connected to a high-voltage electrostat Static 90 from Maag & Schenk to apply a voltage of 40 kV, which corresponds to a field strength of 4 kV/cm. Flocking was carried out for 1 min. Subsequently the flocked fabric was dried in a hot air oven at a temperature of 160° C. for 15 min, and the flocking adhesive crosslinked. The flocked textile was freed from loose, unbonded flock by thorough vacuuming with a powerful industrial vacuum cleaner. The weight per unit area of the flock was determined by the customary methods.

The table below contains the weights per unit area obtained with the flock produced by way of example.

TABLE

| | Flock produced according to the invention g/m$^2$ | Conventionally produced flock g/m$^2$ |
|---|---|---|
| Example 1, 6 | 53 | 35 |
| Example 2, 5 | 120 | 83 |
| Example 3, 7 | 122 | 105 |

I claim:

1. A process for preparing a flock for the mechanical and/or electrostatic flocking, in which the flockmaking tow is introduced into a sleeve which is permeable to liquid of a treatment bath, the flockmaking tow is subjected in this form to at least one treatment bath and is then cut into flock.

2. A process according to claim 1, in which the flockmaking tow consists of manmade fibres.

3. A process according to claim 1, in which the flockmaking tow consists of synthetic fibres.

4. A process according to claim 1, in which the flockmaking tow consists of viscose or polyester fibres.

5. A process according to claim 3, in which the flockmaking tow consists of polyacrylonitrile or polyamide fibres.

6. A process according to claim 1, in which the flockmaking tow in the sleeve is subjected to one or more treatment baths to dye the flockmaking tow and to finish the flockmaking tow with one or more textile auxiliaries.

7. A process according to claim 6, in which the flockmaking tow in the sleeve is subject first to a dyebath and then to at least one bath containing textile auxiliaries.

8. A process according to claim 1, in which the sleeve is a perforated film or textile net of a material having a chemical composition other than that of the flockmaking tow and being inert under the conditions of the treatment bath(s).

9. A process according to claim 8, in which the sleeve is a tubular sheetlike structure made of polyester, polyamide or polypropylene.

10. A process according to claim 9, in which the sleeve is a knitted net or a circular knit.

11. A flock whenever prepared by the process of claim 1.

* * * * *